US010137565B2

(12) United States Patent
Arseneau et al.

(10) Patent No.: US 10,137,565 B2
(45) **Date of Patent: *Nov. 27, 2018**

(54) ERGONOMIC HANDLE AND STRUCTURES OPERABLE IN CONJUNCTION THEREWITH

(71) Applicants: Allen Arseneau, Hingham, MA (US); Diana Arseneau, Hingham, MA (US)

(72) Inventors: Allen Arseneau, Hingham, MA (US); Diana Arseneau, Hingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/824,569

(22) Filed: Nov. 28, 2017

(65) Prior Publication Data

US 2018/0079066 A1 Mar. 22, 2018

Related U.S. Application Data

(63) Continuation of application No. 14/279,908, filed on May 16, 2014, now Pat. No. 9,827,661.

(60) Provisional application No. 61/824,897, filed on May 17, 2013.

(51) Int. Cl.

| | |
|---|---|
| ***B65D 25/10*** | (2006.01) |
| ***B25G 1/10*** | (2006.01) |
| ***A47G 19/22*** | (2006.01) |
| ***A47G 21/02*** | (2006.01) |
| ***B65D 25/28*** | (2006.01) |

(52) U.S. Cl.

CPC ..... *B25G 1/102* (2013.01); *A47G 19/22* (2013.01); *A47G 21/02* (2013.01); *B65D 25/2805* (2013.01); *Y10T 16/476* (2015.01)

(58) Field of Classification Search

None

See application file for complete search history.

(56) References Cited

U.S. PATENT DOCUMENTS

| | | | |
|---|---|---|---|
| 482,630 | A | 9/1892 | Fowler |
| 1,778,175 | A | 10/1930 | Thune |
| D101,865 | S | 11/1936 | Fuerst |

(Continued)

FOREIGN PATENT DOCUMENTS

| | | |
|---|---|---|
| DE | 29511782 | 10/1995 |
| DE | 29511782 U1 | 10/1995 |

(Continued)

OTHER PUBLICATIONS

International Search Report for International Application No. PCT/US2014/038403.

(Continued)

*Primary Examiner* — Andrew T Kirsch
*Assistant Examiner* — Don M Anderson
(74) *Attorney, Agent, or Firm* — Lando & Anastasi, LLP

(57) ABSTRACT

An ergonomic handle configuration has a larger diameter than known conventional handles. The handle is configured with a predetermined combination of convex and concave curvatures that combine in such a way as to mimic a curvature of a user's palm along an area of contact of the palm with the handle, as well as to mimic a curvature of a user's fingers when curled to grip the handle along an area of contact of the fingers with the handle, when a user grips the handle. In addition, implementations of the handle in combination with a container or implement can include a thumb rest that is specifically configured to engage a thumb of a user in a neutral posture thumb position when gripping the handle.

29 Claims, 6 Drawing Sheets

(56) References Cited

U.S. PATENT DOCUMENTS

| | | | |
|---|---|---|---|
| D102,166 | S | 12/1936 | Kirstein |
| D157,859 | S | 3/1950 | Glukes |
| D168,218 | S | 11/1952 | Falk |
| 2,723,072 | A | 11/1955 | Sayford, Jr. |
| 2,979,225 | A | 4/1961 | Noffsinger |
| 3,079,037 | A | 2/1963 | Kaufmann |
| 3,095,132 | A | 6/1963 | Hawley |
| 3,189,937 | A | 6/1965 | Sciortino |
| 3,246,786 | A | 4/1966 | Holley |
| 3,877,614 | A | 4/1975 | Murphy |
| D253,214 | S | 10/1979 | Wilson |
| D259,698 | S | 6/1981 | MacNeill |
| D265,279 | S | 7/1982 | Wright |
| D266,819 | S | 11/1982 | Doyel |
| D279,948 | S | 8/1985 | Weernink |
| 4,643,326 | A | 2/1987 | Klingler |
| D290,921 | S | 7/1987 | Dardashti |
| D291,405 | S | 8/1987 | Finesman et al. |
| D300,112 | S | 3/1989 | Osterhout |
| D304,154 | S | 10/1989 | Osterhout |
| D309,416 | S | 7/1990 | Britz |
| 4,957,224 | A | 9/1990 | Kessler et al. |
| 5,054,638 | A | 10/1991 | Rose |
| D337,187 | S | 7/1993 | Hampshire |
| D341,985 | S | 12/1993 | Bunn et al. |
| D345,675 | S | 4/1994 | Charland |
| D351,315 | S | 10/1994 | van Stolk |
| D355,329 | S | 2/1995 | Ullmann |
| D360,807 | S | 8/1995 | Scholfield |
| D363,001 | S | 10/1995 | Scholfield |
| D365,492 | S | 12/1995 | Rorke |
| D368,205 | S | 3/1996 | Rausch |
| 5,505,330 | A | 4/1996 | Nunes |
| 5,558,240 | A | 9/1996 | Karp |
| D375,016 | S | 10/1996 | Ullmann |
| 5,586,682 | A | 12/1996 | Yeh |
| 5,597,190 | A | 1/1997 | DeMars |
| 5,613,274 | A | 3/1997 | Gerdmann et al. |
| 5,683,007 | A | 11/1997 | Scholfield |
| 5,683,009 | A | 11/1997 | King |
| 5,687,556 | A | 11/1997 | Lintz |
| D389,005 | S | 1/1998 | Brady |
| D390,416 | S | 2/1998 | Hippen et al. |
| D393,776 | S | 4/1998 | Kessler |
| 5,737,803 | A | 4/1998 | Tisdale |
| 5,788,113 | A | 8/1998 | Yeh |
| D409,446 | S | 5/1999 | St. John et al. |
| 6,076,699 | A | 6/2000 | Seager et al. |
| D433,866 | S | 11/2000 | Cautereels et al. |
| D433,877 | S | 11/2000 | Bickert et al. |
| D434,599 | S | 12/2000 | Brady et al. |
| D438,761 | S | 3/2001 | Settele |
| D441,007 | S | 4/2001 | Simons et al. |
| 6,244,461 | B1 | 6/2001 | Roberts et al. |
| D456,212 | S | 4/2002 | Bridges |
| D456,442 | S | 4/2002 | Simons et al. |
| D459,942 | S | 7/2002 | Miller |
| 6,446,830 | B1 | 9/2002 | Ocic |
| 6,471,390 | B1 | 10/2002 | Cuthbertson et al. |
| 6,502,314 | B1 | 1/2003 | McCatty |
| D474,653 | S | 5/2003 | Stewart |
| D475,244 | S | 6/2003 | Trombly |
| 6,729,665 | B1 | 5/2004 | Posey et al. |
| D505,268 | S | 5/2005 | Potempa |
| D513,957 | S | 1/2006 | Thirouin |
| D532,274 | S | 11/2006 | Demar et al. |
| D546,149 | S | 7/2007 | Chen |
| D560,970 | S | 2/2008 | Yelland |
| D561,536 | S | 2/2008 | Virgilio |
| D563,169 | S | 3/2008 | Gibbons et al. |
| D587,980 | S | 3/2009 | Rosenbohm |
| D595,133 | S | 6/2009 | Lewis |
| D605,017 | S | 12/2009 | McElmury |
| 7,673,766 | B1 | 3/2010 | Yalon |
| D614,011 | S | 4/2010 | Hyp |
| D629,249 | S | 12/2010 | Snyker |
| D639,608 | S | 6/2011 | Tohm, Sr. |
| D671,375 | S | 11/2012 | Cloutier et al. |
| D679,949 | S | 4/2013 | Meritt |
| D683,591 | S | 6/2013 | Cahen |
| D684,428 | S | 6/2013 | Spencer |
| 8,459,479 | B2 | 6/2013 | Yourist |
| D700,811 | S | 3/2014 | Lin |
| D701,014 | S | 3/2014 | Marsden et al. |
| D717,112 | S | 11/2014 | Wang et al. |
| 8,887,948 | B2 | 11/2014 | Lapine |
| D730,145 | S | 5/2015 | Eriksson et al. |
| D739,295 | S | 9/2015 | Thuma et al. |
| D747,929 | S | 1/2016 | Arseneau et al. |
| D760,021 | S | 6/2016 | Lapsker |
| 9,827,661 | B2 | 11/2017 | Arseneau et al. |
| 2002/0023359 | A1 | 2/2002 | Peppel et al. |
| 2002/0124353 | A1 | 9/2002 | Holland-Letz |
| 2002/0153381 | A1 | 10/2002 | Rohe |
| 2003/0075550 | A1 | 4/2003 | Kenny |
| 2004/0040160 | A1 | 3/2004 | Cohen et al. |
| 2006/0213033 | A1 | 9/2006 | Wasserman et al. |
| 2011/0259891 | A1 | 10/2011 | Thibault |
| 2012/0060879 | A1 | 3/2012 | Webb |
| 2014/0339246 | A1 | 11/2014 | Arseneau et al. |
| 2018/0079066 | A1 | 3/2018 | Arseneau et al. |

FOREIGN PATENT DOCUMENTS

| | | |
|---|---|---|
| EP | 1447182 | 8/2004 |
| EP | 1447182 A1 | 8/2004 |
| TW | M448956 | 3/2013 |
| TW | M448956 U | 3/2013 |

OTHER PUBLICATIONS

Granny Jo Dignity Mug, CaregiverProducts.com, <http\\web.archive.org/web/20121210203348/http:www.caregiverproducts.com/granny-jo-dignity-mug.html>, Retrieved from the Internet on Nov. 14, 2014.

Yanko Design, "Mug for My Lips Web Page" dated Apr. 2, 2008.

Extended European Search Report for European Application No. 14797537.9 dated Dec. 23, 2016.

ERGONOMIC HANDLE AND STRUCTURES OPERABLE IN CONJUNCTION THEREWITH

RELATED APPLICATION

This application claims priority under 35 U.S.C. § 120 as a continuation of U.S. States Patent Application No. 14/279,908, filed May 16, 2014, which claims priority to, and the benefit of, United States Provisional Application No. 61/824,897, filed May 17, 2013, for all subject matter common to each application. The disclosures of said applications are hereby incorporated by reference in their entirety.

FIELD OF THE INVENTION

The present invention relates to ergonomic handles suitable for enabling a user to easily grip and control the handle and any corresponding structure (i.e., implement or container) coupled thereto. In particular, the present invention relates to an ergonomic handle having an elongate structure with combinations of convex and concave curvatures configured to mimic a contour of a palm and fingers of a user gripping the handle, and having a cross-sectional length and width that is derived from hand dimensional data, wherein the handle is operable in conjunction with a container, implement, or other structure.

BACKGROUND

Generally, handles for use with containers or implements such as tools or utensils are often thin, difficult to grasp, in some instances are too closely attached to the implement or container, and are not long enough to provide enough room for the average user's hand, making handles generally uncomfortable and difficult to use. In fact, many users recognize the discomfort of grasping or holding handles of containers, such as coffee mugs, tea cups, or tea pots. In many handle configurations, users with relatively larger than average hands can only fit one, two, three, or sometimes zero fingers inside many such handles, making the act of holding the container very uncomfortable and strenuous on their wrists, hands, and fingers. In addition, as people develop chronic medical conditions such as arthritis, it becomes more difficult to firmly grasp handles conventionally found on containers and implements. Studies suggest that contorting one's joints in unnatural ways, such as users must do when trying to drink from a mug with a small and thin handle, may lead to, or worsen, arthritis and other joint conditions.

It is possible that until now, handles of drinking containers have not been designed to be ergonomic because of factors including the additional cost of production, the increase in weight, or the physical constraints of the material being used.

Different materials have different physical constraints. For example, working with clay (the raw material for ceramic coffee mugs) requires that the ceramic be 1.5 cm (0.6 inches) or less in thickness in at least one dimension. When baking or setting the ceramic, these sections that are greater than 1.5 cm (0.6 inches) in all dimensions are prone to cracking, exploding, or not thoroughly drying. As such, configuring handles to be more ergonomic is limited by the inability to make large diameter handles out of conventional materials, such as clay, for conventional containers such as ceramic coffee mugs.

SUMMARY

There is a need for an improved ergonomic handle that can be utilized in conjunction with containers or implements to alleviate or reduce the difficulties users experience with conventional handles. The present invention is directed toward further solutions to address this need, in addition to having other desirable characteristics.

In accordance with an example embodiment of the present invention, an improved handle for drinking and eating containers such as mugs, cups, and the like is provided. The improved handle is a comfortable and ergonomic alternative to existing ceramic handles; it is shaped to mimic hand geometries, has the appropriate thickness to be medically ergonomic, is structurally sound, has ample room for most large user hands, can have multiple comfortable positions for a user's thumb, does not heat up excessively, is lightweight, is easy to clean, and is aesthetically pleasing. This handle can be used for many different types of containers, including but not limited to mugs, bowls, vases, tea cups, bowls, drinking glasses, pots, pans, measuring cups, and pitchers, as well as for implements, such as tools and utensils.

In accordance with an example embodiment of the present invention, a handle includes an elongate grip region having a first end and a second end opposite the first end. The elongate grip region of the handle includes a first side, a second side, a third side, and a fourth side, combining to form an entire outer surface of the elongate grip region. The handle includes a first grip area on the first side extending between the first end and the second end. The first grip area has a midpoint between the first end and the second end. The handle includes a second grip area on the second side extending between the first end and the second end and opposite the first grip area and first side. The handle includes a third grip area on the third side extending between the first end and the second end and connecting the first grip area with the second grip area. The handle includes a fourth grip area on the fourth side extending between the first end and the second end, opposite the third grip area and third side, and connecting the first grip area with the second grip area. The first grip area on the first side includes a contoured surface having a convex curvature out from the handle originating from the second end and extending beyond the midpoint toward the first end. The convex curvature transitions to a concave curvature. The concave curvature then transitions to a second convex curvature proximal the first end. The convex curvature, concave curvature, and second convex curvature are configured so as to together mimic a curvature of a user's palm along an area of contact of the palm with the elongate grip region when a user grips the elongate grip region. The second grip area on the second side includes a contoured surface having a convex curvature out from the handle and extending entirely between the first end and the second end of the elongate grip region. The second grip is configured so as to mimic a curvature of a user's fingers when curled to grip the handle along an area of contact of the fingers with the elongate grip region.

In accordance with aspects of the present invention, the third grip area on the third side can include an indented region extending between the first end and the second end of the elongate grip region. The fourth grip area on the fourth side, likewise can include an indented region extending between the first end and the second end of the elongate grip region.

In accordance with aspects of the present invention, an effective diameter of the handle is greater than 1.5 cm (0.6 inches). In another aspect, an effective outer circumference of the handle is greater than about 4 cm (1.57 inches). In another aspect, the handle has an effective diameter of greater than 1.5 cm (0.6 inches), while simultaneously no cross-sectional portion of the handle has a thickness of greater than 1.5 cm (0.6 inches). In another aspect, the handle has an effective diameter of about 2.5 cm (0.98 inches). In another aspect, the handle has an effective outer circumference of about 7.9 cm (3.1 inches).

In accordance with aspects of the present invention, the indented region of the third grip area on the third side is sized, dimensioned, and configured to receive a user's metacarpophalangeal joints on a palm side of the user's hand. In another aspect, the indented region of the fourth grip area on the fourth side is sized, dimensioned, and configured to receive a user's metacarpophalangeal joints on a palm side of the user's hand. In another aspect, the indented region of the third grip area on the third side is generally a mirror image configuration of the indented region of the fourth grip area on the fourth side. In another aspect, the indented region of the third grip area on the third side and the indented region of the fourth grip area on the fourth side intersect creating an opening there through.

In accordance with one aspect of the present invention, the handle has a generally I-shaped cross-section at a midpoint of the handle.

In accordance with aspects of the present invention, the handle is disposed in combination with another structure to form a container or implement. In another aspect, the handle is disposed in combination with a blade to form a cutting tool. In another aspect, the handle is disposed in combination with a spatula to form a grilling utensil.

In accordance with one aspect of the present invention, the handle is made of or manufactured of metal, wood, glass, enamel, ceramic, synthetic, plastic, or composite materials, or combinations thereof.

In accordance with an example embodiment of the present invention, a container includes a base. The container includes a wall surrounding the base and forming an interior chamber defined by the base and an opening with a rim opposite the base. The wall has an exterior surface and an interior surface. The container includes a handle coupled with the wall, via a first connecting member and a second connecting member, at the exterior surface. The container includes an elongate grip region disposed on the handle and having a first end and a second end opposite the first end. The first connecting member transitions the wall proximal the rim into the grip region proximal the first end, and the second connecting member transitions the wall proximal the base into the grip region proximal the second end. The first connecting member and the second connecting member connecting the elongate grip region with the wall of the container. The elongate grip region of the handle includes a first side, a second side, a third side, and a fourth side, combining to form an entire outer surface of the elongate grip region. The container includes a first grip area on the first side extending between the first end and the second end. The first grip area has a midpoint between the first end and the second end. The container includes a second grip area on the second side extending between the first end and the second end and opposite the first grip area and first side. The container includes a third grip area on the third side extending between the first end and the second end and connecting the first grip area with the second grip area. The container includes a fourth grip area on the fourth side extending between the first end and the second end, opposite the third grip area and third side, and connecting the first grip area with the second grip area. The first grip area on the first side includes a contoured surface having a convex curvature out from the handle originating from the second end and extending beyond the midpoint toward the first end. The convex curvature transitions to a concave curvature. The concave curvature then transitions to a second convex curvature proximal the first end. The convex curvature, concave curvature, and second convex curvature are configured so as to together mimic a curvature of a user's palm along an area of contact of the palm with the elongate grip region when a user grips the elongate grip region. The second grip area on the second side includes a contoured surface having a convex curvature out from the handle toward the wall of the container and extending entirely between the first end and the second end of the elongate grip region. The second grip area is configured so as to mimic a curvature of a user's fingers when curled to grip the handle along an area of contact of the fingers with the elongate grip region.

In accordance with aspects of the present invention, the third grip area on the third side can include an indented region extending between the first end and the second end of the elongate grip region. The fourth grip area on the fourth side likewise can include an indented region extending between the first end and the second end of the elongate grip region. The container includes a thumb rest region disposed on the first connecting member and configured to engage a thumb of a user in a neutral posture thumb position when gripping the elongate grip region.

In accordance with one aspect of the present invention, the container includes a stability nub disposed on a lower base portion of the second connecting member and providing stability and support for the handle and the container when resting on a flat surface.

In accordance with aspects of the present invention, the second side and the second grip area are positioned to form a gap between the elongate grip and the exterior surface of the wall of the container. In another aspect, the gap is sized and dimensioned to be about 2.2 cm (0.85 inches).

In accordance with one aspect of the present invention, the container includes a mug, tea cup, bowl, pitcher, drinking glass, pot, pan, or measuring cup.

In accordance with an embodiment of the present invention, a container made of ceramic material has a ceramic base. A ceramic wall surrounds the base and forms an interior chamber defined by the base with an opening with a rim opposite the base. The wall has an exterior surface and an interior surface. A ceramic handle couples with the wall, via a first connecting member and a second connecting member, at the exterior surface. The handle includes an elongate grip region having a first end and a second end opposite the first end, the elongate grip region of the handle comprising a first side, a second side, a third side, and a fourth side, combining to form an entire outer surface of the elongate grip region; a first grip area on the first side extending between the first end and the second end; a second grip area on the second side extending between the first end and the second end and opposite the first grip area and first side; a third grip area on the third side extending between the first end and the second end and connecting the first grip area with the second grip area; and a fourth grip area on the fourth side extending between the first end and the second end, opposite the third grip area and third side, and connecting the first grip area with the second grip area. An indented region is disposed in the third grip area on the third side. The first grip area, the second grip area, the third grip area, the fourth grip area, the indented region disposed on the third grip area, and the indented region disposed on the fourth grip area, are made of the ceramic material. The handle has an effective diameter of greater than 1.5 cm (0.6 inches), while simultaneously no cross-sectional portion of the handle has a thickness of greater than 1.5 cm (0.6 inches).

In accordance with aspects of the present invention, the container further includes an indented region disposed in the fourth grip area on the fourth side. An effective diameter of the handle can be greater than 1.5 cm (0.6 inches), and an effective outer circumference of the handle can be greater than about 4 cm (1.57 inches). The handle can have an effective diameter of about 2.5 cm (0.98 inches) and an effective outer circumference of about 7.9 cm (3.1 inches). The handle can include a generally I-shaped cross-section at a midpoint of the handle.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1A:
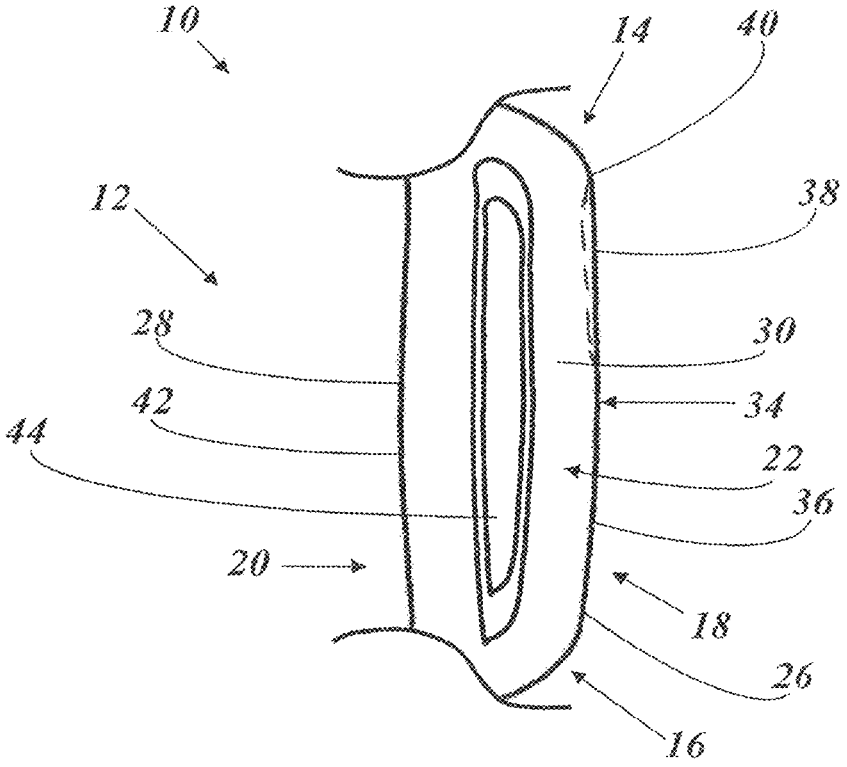
FIG. 1A is a side view of a handle in a generally vertical orientation, with break lines indicating possible points of connection with another structure.

An illustrative embodiment of the present invention relates to an ergonomic handle configuration that has a larger diameter than known conventional handles. The larger diameter dimension was determined based on anthropometric hand measurement data and ideal grip span for optimal grip strength. The handle is specifically configured with a predetermined combination of convex and concave curvatures that combine in such a way as to mimic a curvature of a user's palm along an area of contact of the palm with the handle, as well as to mimic a curvature of a user's fingers when curled to grip the handle along an area of contact of the fingers with the handle, when a user grips the handle. In addition, implementations of the handle in combination with a container or implement further include a thumb rest that is specifically configured to engage a thumb of a user in a neutral posture thumb position when gripping the handle. Finally, implementations of the handle with a container or implement can further include a stability nub disposed on a lower base portion of the handle providing additional stability and support for the handle and container or implement when resting on a flat surface. The configuration of the present invention is believed to aid users having certain medical conditions, such as arthritis and other joint conditions, by reducing pain and discomfort or reducing incidence of such conditions.

As utilized herein, the term "ergonomic" and variations thereof should be interpreted in accordance with its conventional meaning, namely, an applied science concerned with designing and arranging things people use so that the people and things interact most efficiently and safely, and also including elements of biotechnology, human engineering, and human factors.

FIGS. 1A through 6, wherein like parts are designated by like reference numerals throughout, illustrate an example embodiment or embodiments of an ergonomic handle, alone and in several implementations, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 1B:
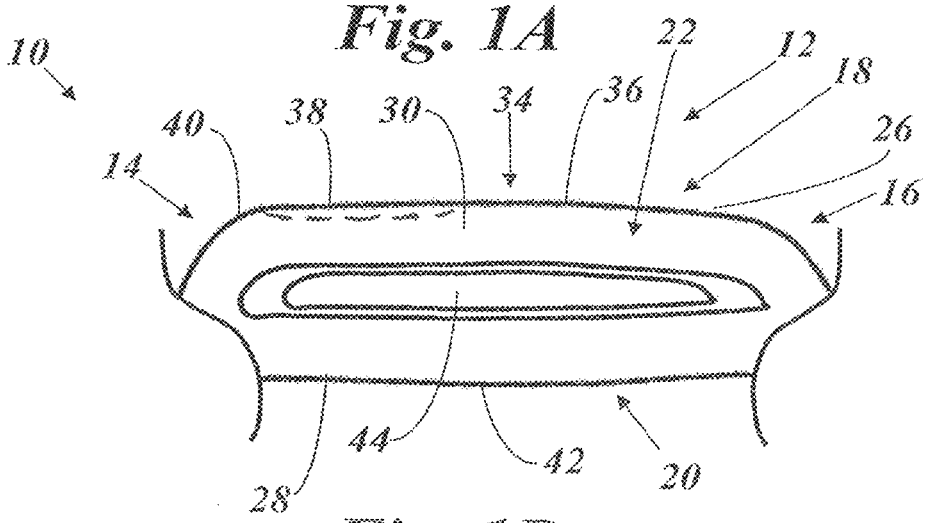
FIG. 1B is a side view of the handle of FIG. 1A in a generally horizontal orientation, with break lines indicating possible points of connection with another structure.

FIGS. 1A and 1B show a handle 10 with break lines at either end indicating the handle 10 may be coupled or connected with additional structure beyond the handle depicted in the figure. More specifically, FIG. 1A shows the handle in a vertical orientation, while FIG. 1B shows the identical handle in horizontal orientation. The orientation of the handle 10 will depend on the particular container or implement to which the handle 10 is connected. Those of skill in the art will further appreciate that the handle 10 can be arranged or configured at any angle between the two depicted (i.e., 0° and 90°), such that the present invention is by no means limited to the two positions illustrated.

The handle 10 includes an elongate grip region 12 having a first end 14 and a second end 16 opposite the first end 12. The elongate grip region 12 of the handle 10 further includes a first side 18, a second side 20, a third side 22, and a fourth side 24 (the backside of the elongate grip region 12, not shown in this figure), combining to form an entire circumferential outer surface of the elongate grip region 12. That is, the handle 10 includes the elongate grip region 12, which is formed of generally four sides or areas that combine to create the entire elongate grip region 12. Those of skill in the art will appreciate that each of the sides 18, 20, 22, 24 may be abruptly defined, such as with more defined corners or edges, or may not be specifically defined by any edges or corners, such as with a generally cylindrical shaped elongate grip region 12. All variations between these two extremes are contemplated by the present invention. The identification of each of the sides 18, 20, 22, 24 is provided merely for clarity of description when discussing specific features and configurations of each side, relative to the hand of a user gripping the elongate grip region 12.

More specifically, a first grip area 26 on the first side 18 extends between the first end 14 and the second end 16. The first grip area 26 has a midpoint 34 between the first end 14 and the second end 16. A second grip area 28 on the second side 20 extends between the first end 14 and the second end 16 and is on a side of the handle 10 that is opposite the first grip area 26 and first side 18. A third grip area 30 on the third side 22 extends between the first end 14 and the second end 16, and connects the first grip area 26 with the second grip area 28. A fourth grip area 32 (not shown in this figure because it is on the backside of the handle I 0) on the fourth side 24 extends between the first end 14 and the second end 16, opposite the third grip area 30 and third side 22, and connecting the first grip area 26 with the second grip area 28. The first grip area 26 on the first side 18 has a contoured surface having a convex curvature 36 out from the handle 10 originating from the second end 16 and extending beyond the midpoint 34 toward the first end 14. The convex curvature 36 transitions to a concave curvature 38. The concave curvature 38 then transitions to a second convex curvature 40 proximal the first end 14. The end result of the configuration described is that the convex curvature 36, concave curvature 38, and second convex curvature 40 are configured so as to, together in combination, mimic a curvature of a user's palm along an area of contact of the palm with the elongate grip region 12 when a user grips the elongate grip region 12, wrapping their fingers around the elongate grip region 12 with their palm against the first grip area 26. These curvatures can be mathematically defined, using multi-order polynomial equations, that were derived from empirical evidence. The equations were determined by mapping out hand geometries along the user's palm, and along the user's fingers. This data was then converted into smoothed equations, using a mathematical curve fitting function. The two multi-order polynomial curves that are utilized in accordance with an illustrative embodiment of the present invention in the design, dimension, and configuration handle 10 are (1): $y=1.82\times10^{-6}x^4-3.33\times10^{-4}x^3+1.73\times10^{-2}x^2-2.49\times10^{-1}x+28.9$ and (2): $y=2.14\times10^{-6}x^4-3.66\times10^{-4}x^3+1.74\times10^{-2}x^2-2.05\times10^{-1}x+30.0$. Those of skill in the art will appreciate that multi-ordered polynomial curves can be manipulated slightly and still produce a same or similar result. As such, the above equations are intended as representative of the type of curves that are required to form handles in accordance with the teachings of the present invention, but are by no means specifically limiting. Equivalent multi-order polynomial equations defining equivalent curves having the desired features and functionality of the presently claimed invention are considered to be included in the subject matter of the present disclosure and invention.

The second grip area 28 on the second side 20 has a contoured surface having a convex curvature 42 out from the handle 10 and extending entirely between the first end 14 and the second end 16 of the elongate grip region 12. The convex curvature 42 is configured so as to mimic a curvature of a user's fingers when curled to grip the handle 10 along an area of contact of the fingers with the elongate grip region 12 (i.e., along the second grip area 28). Said differently, the convex curvature 42 is sized, dimensioned, and configured to enable an average user's hand to comfortably rest against the top (if the user's hand was placed at the very top of the handle), or at the bottom (if the user's hand was placed at the very bottom of the handle). This convex curvature 42 reduces any pinch-points, and reduces the likelihood that a hand would slip by keeping the top of the transverse interior top flat, and not angled upwards.

In accordance with one embodiment, the third grip area 30 on the third side 22 has an indented region 44 extending between the first end 14 and the second end 16 of the elongate grip region 12. The indented region 44 is sized, dimensioned, and configured to receive the basilar joint palm portion and/or the distal phalanx finger portions of an average user's hand. The fourth grip area 32 on the fourth side 24 has an indented region 46 (not shown in this figure because it is on the backside of the handle 10) extending between the first end 14 and the second end 16 of the elongate grip region 12. The indented region 46 is likewise sized, dimensioned, and configured to receive the basilar joint palm portion and/or the distal phalanx finger portions of an average user's hand. The indented regions 44, 46 enable the configuration wherein at least one point on all cross-sections is 1.5 cm (0.6 inches) or less.

Figure 2A:
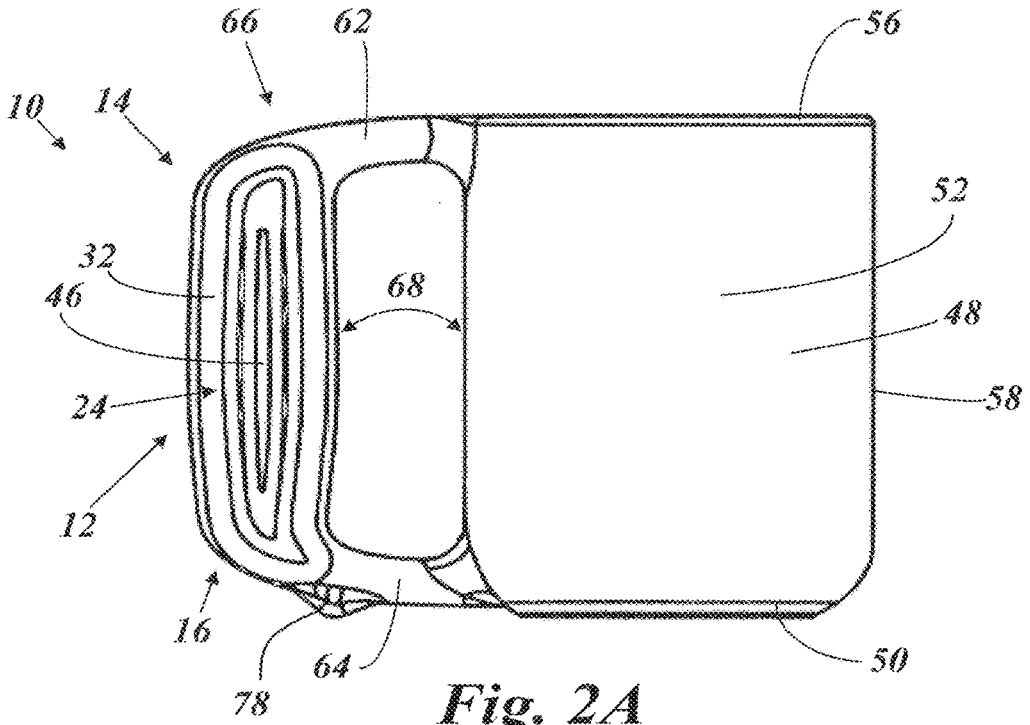
FIG. 2A is a side view of the handle operable in conjunction with a container.
Figure 2B:
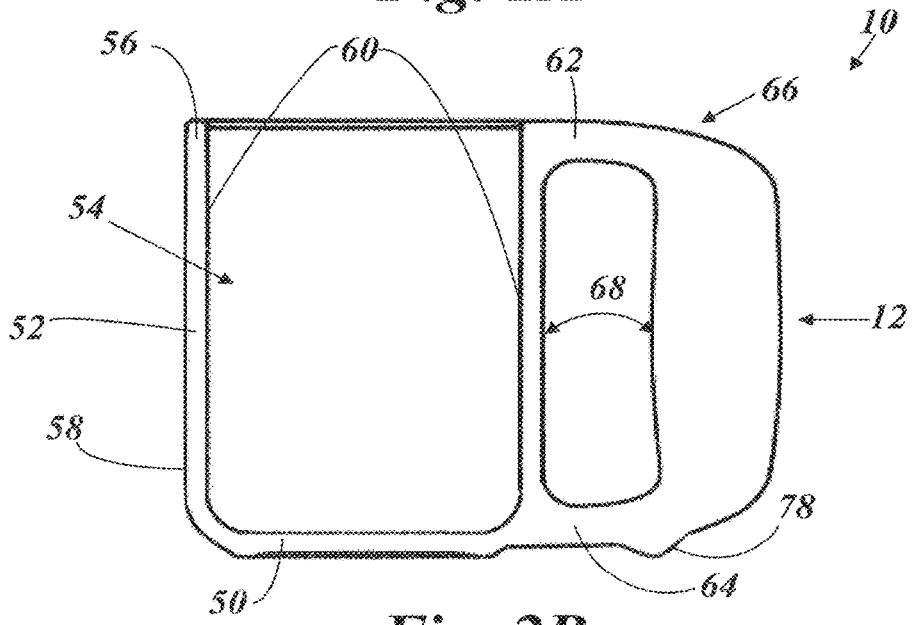
FIG. 2B is a cross-sectional view of the handle operable in conjunction with the container of FIG. 2A.
Figure 3A:
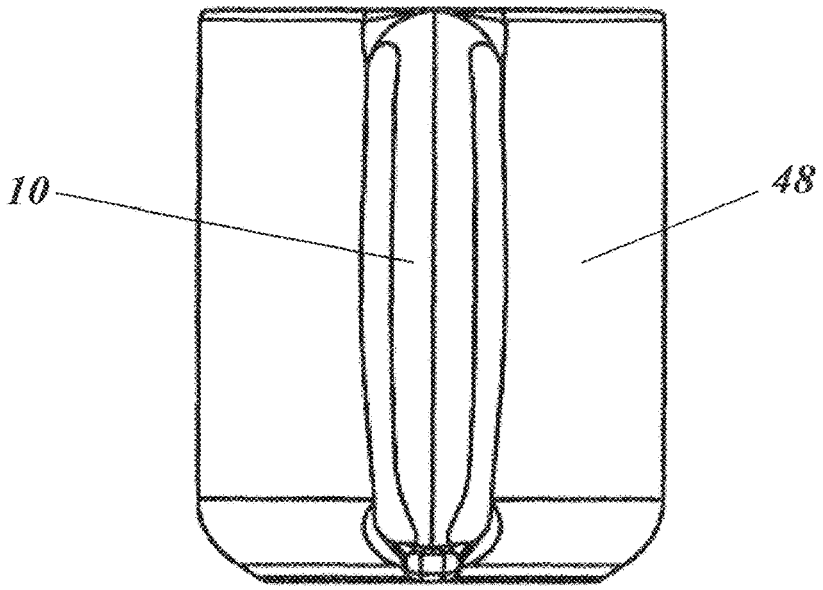
FIG. 3A is an end view of the handle operable in conjunction with the container of FIG. 2A.
Figure 3B:
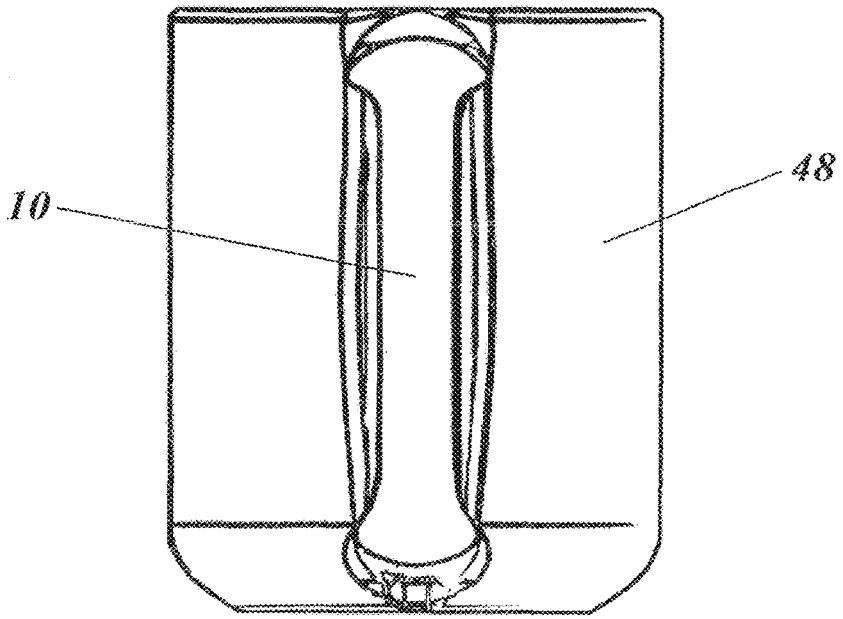
FIG. 3B is a cross-sectional end view of the handle operable in conjunction with the container of FIG. 2A.

In FIGS. 1A and 1B, the fourth side 24, the fourth grip area 32, and the indented region 46, are all not shown in these figures because they are on the back side of the handle 10. However, FIG. 2A shows the back side of the handle 10, and correspondingly these components. For purposes of simplicity of description, it is intended that the fourth side 24 is essentially a mirror image configuration of the third side 22, the fourth grip area 32 is essentially a mirror image configuration of the third grip area 30, and the indented region 46 is essentially a mirror image configuration of the indented region 44. That said, one of skill in the art will appreciate that there is no requirement that the mirror image configurations occur. Rather, the configurations may have structural and shape differences, as desired. Yet for purposes of the present description, it is assumed that these configurations are essentially mirror images of each other.

While the present invention is directed to the handle 10 as described herein, handles are mostly found in combination with other devices, such as containers or implements. Depending on the particular container or implement, the handle 10 is typically positioned in a generally vertical orientation, such as depicted in FIG. 1A, or a generally horizontal orientation, such as depicted in FIG. 1B. Certain example implementations of the present handle 10 will now be described below.

The handle 10 can be formed of ceramic or another suitable material, which is comfortable and ergonomic and can be affixed to various containers, including mugs, tea cups, drinking glasses, bowls, pots, pans, measuring cups, and other such containers. The physiological characteristics of the average human hand, as described later herein, fall within a general range of typical dimensions. As a result of such average user hand dimensions, it was determined by the present inventors that a preferred effective diameter of the handle should be generally greater than about 1.5 cm (0.6 inches), which results in an effective outer circumference of about 4 cm (1.57 inches) to achieve the most ergonomic configuration and optimize hand grip strength. In accordance with one example embodiment, users have demonstrated a preference for handles having an effective diameter of about 1 inch (2.54 cm) to 1.5 inches (3.81 cm). The effective diameter accommodates a number of different cross-sectional shapes, including but not limited to a circle, oval, square, rectangle, or any other suitable shape which is generally greater in effective diameter than about] 0.5 cm (0.6 inches). In accordance with an example embodiment, the inventors have found that a handle 10 having an effective diameter of about 2.5 cm (0.98 inches) and an effective outer circumference of about 7.9 cm (3.1 inches) provides sufficient structure to comfortably and ergonomically wrap one's hand around such a handle 10. Handles 10 sized and dimensioned in accordance with the quantities expressed herein result in a more ergonomic and therapeutically effective handle, especially for users having stiff or arthritic hand conditions, or other such conditions.

The phrase "effective diameter" as utilized throughout the present description is intended to be utilized consistent with its ordinary and known usage. Specifically, the effective diameter is the measurement of the diameter of an imaginary flexible tube wrapped tightly around the object and not folded upon itself. For example, a tube wrapped around the letter "C" would follow the curvature of the letter on the top, bottom, and left sides, and then extend directly across the gap on the right side. The dimension of the diameter of the tube is the effective outer diameter. Correspondingly, the phrases "effective cross-sectional area" or "effective outer circumference" as utilized throughout the present description are intended to be utilized consistent with their ordinary and known usage. Specifically, the effective cross-sectional area or circumference are the measurements of the total cross-sectional area or circumference that result from measurement of an imaginary flexible tube wrapped tightly around the object and not folded upon itself, and the corresponding calculations to determine area or circumference. The dimension or calculation of the cross-sectional area of the tube that results is the effective cross-sectional area, while the dimension or calculation of the circumference that results is the effective outer circumference.

In accordance with example embodiments, the handle 10 as described herein can be coupled or connected with additional structure beyond the handle 10. FIGS. 2A through 4B and 6 illustrate the handle 10 coupled or connected with a container 48. The container includes a base 50. A wall 52 surrounds the base 50 and forms an interior chamber 54 defined by the base 50 and an opening with a rim 56 opposite the base 50. The wall 52 has an exterior surface 58 interior surface 60. The handle 10 couples with the wall 52 of the container 48 by operation and configuration of a first connecting member 62 and a second-connecting member 64. The first connecting member 62 transitions the wall 52 proximal the rim 56 into the elongate grip region 12 proximal the first end 14. The second connecting member 64 transitions the wall 52 proximal the base 50 into the elongate grip region 12 proximal the second end 16. The first connecting member 62 and the second connecting member 64 connect the elongate grip region 12 with the wall 52 of the container 48 at the exterior surface 58.

The first connecting member 62 is further configured to include a thumb rest region 66. The thumb rest region 66 is sized, dimensioned, and configured to support a thumb of a user's hand as they are gripping the elongate grip region 12. Specifically, the thumb rest region 66 is disposed on the first connecting member 62 and configured to engage a thumb of a user in a neutral posture thumb position when gripping the elongate grip region 12. A neutral posture thumb position is one in which a resting position of each joint in the thumb experiences the least tension or pressure on nerves, tendons, muscles, and bones of the thumb. It is also the position in which muscles are at their resting length, meaning they are neither contracted nor stretched. By being in a neutral posture thumb position, the thumb of the user and its corresponding joints are in an ergonomically beneficial orientation.

In the example embodiment of the handle 10 coupled or connected with the container 48 in FIGS. 2A through 4B, both the handle 10 and the container can be made of ceramic or clay material. Because ceramic must be no greater than 1.5 cm (0.6 inches) thick to cure properly, the handle 10 as described herein incorporates one or more indentations in the form of the indented regions 44, 46, that allow for a larger effective diameter structure while still maintaining the 1.5 cm (0.6 inches) or less thickness requirement. When ceramic is thicker than 1.5 cm (0.6 inches), it is prone to cracking, exploding, or simply not thoroughly drying. These openings, including grooves, holes, and other shapes, can extend completely through the handle 10, as would be appreciated by those of skill in the art. The term "thickness" in accordance with its usage herein indicates a relative measure of the distance between the two closest edges of the ceramic material at any interior point of the ceramic material. In other words, in the I-shape depicted in FIG. 4B, the distance between the top and the bottom of the "I" can be greater than 1.5 cm (0.6 inches) because the distance between the two vertical portions of the "I" are the two closest edges. In accordance with some embodiments, indented regions 44, 46 do not extend completely through the handle 10; rather, they are formed in various directions, shapes, and sizes, and are located on either side of the handle 10 or at various points on the handle 10. Holes and grooves that do not extend completely through the handle 10 may be placed in one or more surfaces of the handle 10. These openings satisfy the physical constraint for proper setting or drying of the ceramic material by ensuring that any point on the handle has a thickness of 1.5 cm (0.6 inches) or less on at least one dimension.

In addition, one of skill in the art will appreciate that the indented regions 44, 46, whether they pass completely through the handle 10 or not, are sized, dimensioned, and configured to enable easy cleaning, to more readily dissipate extreme temperatures from the handle 10, to not compromise the structural integrity of the handle 10 in any way, to not interfere with the comfort of holding the handle 10, to reduce the overall weight of the handle 10, and be aesthetically pleasing.

In accordance with example embodiments, the indented regions 44, 46 are sized, dimensioned, and configured to be sufficiently wide as to enable a conventional sink sponge or other cleaning apparatus to easily access all surfaces of the handle 10. By increasing the surface area of the ceramic material on the handle 10, heat dissipates more rapidly, and the air-filled gaps act as additional insulators. The indented regions 44, 46 can be configured so that the structural integrity of the handle 10 is not compromised, regardless as to whether a user grips with excessive force. The indented regions 44, 46 are disposed so that they do not interfere with the overall comfort of the handle 10, or minimally impact and/or improve upon the tactile comfort when holding the handle 10. The indented regions 44, 46 provide a means to reduce the overall weight of the handle 10 as well.

The handle 10 itself can have one of several different cross-sectional shapes, including a circle, oval, square, rectangle, irregular shape, I-shaped, or any other suitable shape. The cross-section of the indented regions 44, 46, can likewise have a shape of circle, oval, square, rectangle, irregular shape, or any other suitable shape. The indented regions 44, 46 are sized, dimensioned, and configured to comfortably receive the portion of the user's hand comprising the base knuckles of the user's fingers on the palm side of the user's hand (i.e., the metacarpophalangeal joints) as well as to allow the handle cross-section thickness to be no greater than 1.5 cm (0.6 inches) on any one dimension, be easy to clean, have large enough radii to be comfortable when being held and be easily manufactured, and be aesthetically pleasing. As the user grips the handle 10, the metacarpophalangeal joints on the palm side of the user's hand are received within one of the indented regions 44, 46, depending on which hand is being used (a right hand would grip the handle 10 from the right side such that indented region 46 would be utilized, while a left hand would grip the handle 10 from the left side such that indented region 44 would be utilized). For an average user's hand, the dimensions of the indented regions 44, 46 may be approximately 0.76 cm (0.3 inches) deep and 1.0 cm (0.4 inches) wide. The shape of the indent follows the geometry of the handle itself and the radii inside the indents and on the edges of the indents are large enough for ease of cleaning, ease of manufacturing, and comfort when holding.

Figure 6:
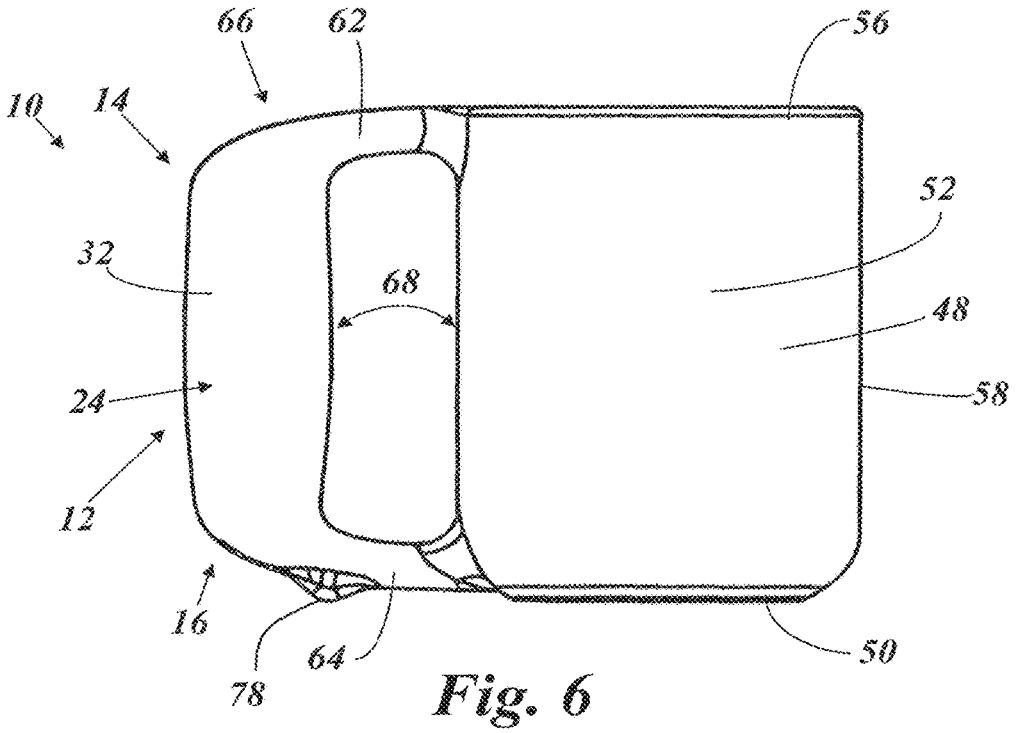
FIG. 6 is a side view of the handle operable in conjunction with the container of FIG. 2A.

In accordance with an example embodiment, the handle 10 as described herein coupled or connected with additional structure beyond the handle 10 as described and shown in FIGS. 2A through 4 can be configured so as to not include the indented regions 44, 46. Such an embodiment is depicted in FIG. 6, wherein the container 48 is the same as depicted elsewhere herein, but the handle 10 has been configured without the indented regions 44, 46. Such a configuration for the handle 10 may be utilized, for example, when the handle is manufactured of a non-ceramic material, or material that does not have the limitations of ceramic materials relating to the maximum thickness allowed as described herein. It should be appreciated that the handle 10 as shown in FIG. 6 both includes all of the concave and convex curvatures on the first side 18 and second side 20 as described herein, and is also intended to depict possible configurations for the elongate handle 10 itself, whether coupled with a container, utensil, tool, or other device, such that the embodiment depicted in this figure without indented regions can be implemented in numerous ways. The embodiment depicted in this figure is in no way limited for use only with a container.

In accordance with an example embodiment, the second side 20 and the second grip area 28 (which are the closest of the sides of the elongate grip region 12 to the container 48) are positioned about 2.2 cm (0.85 inches) from the exterior surface 58 of the wall 52 of the container 48, forming a gap 68. The gap 68 of 2.2 cm (0.85 inches) or more provides sufficient distance for the average user hand to fit around the handle 10 while gripping the handle 10, without requiring their knuckles or other portions of their hand to make contact with the exterior surface 58 of the container 48. The first and second connecting members 62, 64 must be sized and dimensioned to result in the distance of 2.2 cm (0.85 inches) or more between the elongate grip region 12 and the container 48, as would be appreciated by those of skill in the art, given the benefit of the present disclosure.

The handle 10 in accordance with an illustrative embodiment has been designed to accommodate a typical user's hand, which is on average 9.0 cm (3.54 inches) in hand breadth for men and 7.9 cm (3.I inches) in hand breadth for women this hand breadth is measured across the ends of the metacarpal bones (metacarpophalangeal joints); the 95th percentile hand breadth length for adult males is 9.8 cm (3.86 inches) and 8.6 cm (3.4 inches) for women. This information was used to determine the length of the elongate grip region having a first end and a second end opposite the first end, which was determined to be no less than 7.6 cm (3.0 inches). In comparison, many conventional mugs have handles that provide about 3.5 cm to 5.0 cm (1 .4 inches to 2.0 inches) of space for a user's hand breadth.

The thickness of the handle 10 was determined from the size of the proximal, middle, and distal phalanges, the portion of a user's hand that wraps around the inside of the handle 10, specifically to optimize a user's hand grip strength. Research has shown that optimal grip strength occurs with grip spans between 2.4-5.1 cm (1-2 inches). Grip strength declines outside of this range. The proximal phalanx is used to determine gap 68. Conventional handles are generally no more than 2.0 cm (0.8 inches) wide, no more than 1.0 cm (0.4 inches) thick, and the handles are typically angled downward, reducing the amount of space for any user's fingers as one moves down the handle, and providing for less-than-optimal grip strength. As such, the handle 10 of the present invention is sized, dimensioned, and configured, in a superior ergonomic configuration, both as to the handle 10 itself, as well as the distance it is mounted from the container 48.

In accordance with an example embodiment, the second connecting member 64 can further include a stability nub 78 disposed on a lower base portion thereof. The stability nub 78 provides additional stability and support for the handle 10 and the container 48 or implement when resting on a flat surface by making contact with the flat surface.

Figure 4A:
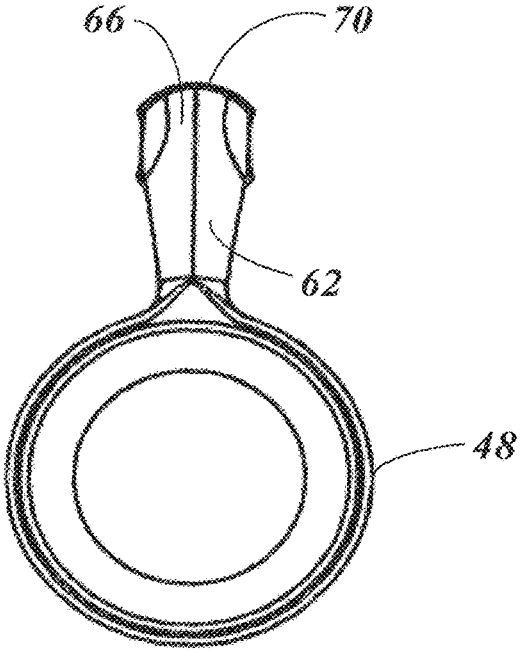
FIG. 4A is a top view of the handle operable in conjunction with the container of FIG. 2A.
Figure 4B:
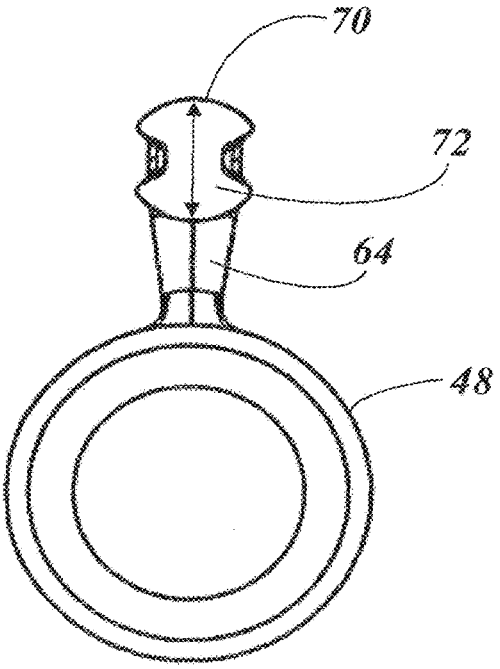
FIG. 4B is a cross-sectional top view of the handle operable in conjunction with the container of FIG. 2A.

FIGS. 4A and 4B illustrate the handle 10 coupled or connected with the additional structure in the form of the container 48 from top view (FIG. 4A) and a top cross-sectional view (FIG. 4B). As can be seen, in addition to the contour described herein to mimic the palm of a user's hand (convex curvature 36, concave curvature 38, second convex curvature 40), the handle 10 can further include a transverse convex curve 70 to effect or result in a rounded handle feel for the user. Those of skill in the art will appreciate other shapes or contours that may be utilized in conjunction with the present invention.

Also shown in FIG. 4B, is a cross-section around the midpoint 34 of the elongate grip region 12 of the handle 10. As can be seen in this example illustrative implementation of the present invention, the cross-section is a generally I-shaped cross-sectional area 72. The I-shape configuration enables the fabrication of the handle 10 in accordance with the dimensions described herein for ergonomic improvement, while also enabling fabrication of the handle 10 in compliance with the rules concerning ceramic materials and the thickness limitations described herein. Those of skill in the art will appreciate that other cross-sectional area shapes may also be permissible in a manner that is compliant with the characteristics of the present invention.

The handle 10 may be affixed to a drinking container, such as a coffee cup or beer mug, or another container, such as a vase, bowl, pot, or pan, or any other such container 48, such that the embodiments described herein are merely illustrative.

Figure 5A:
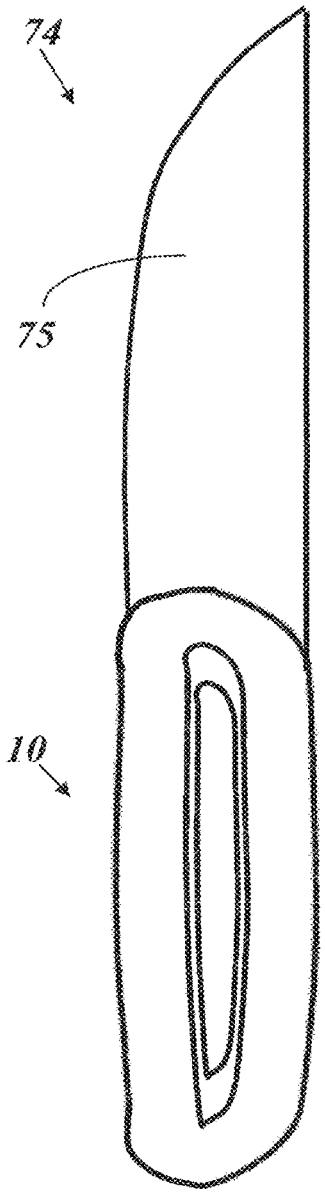
FIG. 5A is a side view of the handle operable in conjunction with a cutting tool.
Figure 5B:
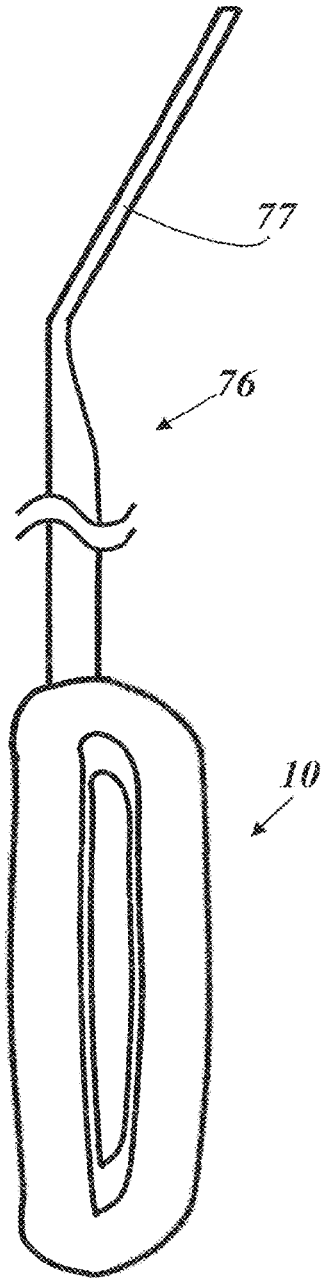
FIG. 5B is a side view of the handle operable in conjunction with a utensil.

FIGS. 5A and 5B illustrate two different example implementations of the handle 10 in combination with another structure. In short, the handle 10 of the present invention may be utilized in combination with an additional structure beyond the handle 10 to form a number of different containers or implements (including utensils and tools). FIG. 5A depicts the handle 10 in combination with a blade 75 to form a cutting tool 74. Note that in this implementation, the handle 10 would typically be utilized in a horizontal orientation, in accordance with FIG. 1B., FIG. 5B depicts the handle 10 in combination with a spatula 77 to form an implement in the form of a grilling utensil 76. Again, the handle 10 would typically be utilized in a horizontal orientation, in accordance with FIG. 1B when combined with the spatula 77. Those of skill in the art will appreciate there are a substantial number of different possible combinations of containers and implements that may be constructed or configured in combination with the handle 10 of the present invention, such that the present invention is by no means limited to the specific illustrative embodiments of containers and implements described herein.

In operation, a user may grasp the handle 10, placing the palm of their hand against the first grip area 26 on the first side 18. When doing so, the contoured surface having the convex curvature 36, the concave curvature 38, and the second convex curvature 40 mimics a curvature of the user's palm along an area of contact of the palm with the elongate grip region 12. This enables total contact between the contoured palm and the elongate grip region 12 without the user experiencing pressure points or other uncomfortable points of irregularity against their hand.

As the user wraps their fingers around the elongate grip region 12 with their palm against the first grip area 26, their fingers match up with the second grip area 28 on the second side 20 with its contoured surface having the convex curvature 42 out from the handle 10 and extending entirely between the first end 14 and the second end 16 of the elongate grip region 12. The convex curvature 42 is configured so as to mimic a curvature of a user's fingers when curled to grip the handle 10 along an area of contact of the fingers with the elongate grip region 12 (i.e., along the second grip area 28). Furthermore, the indented regions 44, 46 receive the metacarpophalangeal joints of the user's hand on the palm side. As such, the user experiences no pressure points or other uncomfortable points of irregularity against their hand. The structure of the handle 10 and elongate grip region 12 decrease the likelihood that a hand would slip by keeping the top of the transverse interior top flat, and not angled upwards. If the handle 10 is implemented in combination with a container 48, then the first connecting member 62 includes the thumb rest region 66. As such, the thumb of the user is placed on the thumb rest region 66 when the user's hand is fully gripping the handle 10 and elongate grip region 12, and the thumb of the user is able to engage the thumb rest region 66 in a neutral posture thumb position.

One of skill in the art will appreciate that the handle 10 of the present invention can be made of a number of different materials, including but not limited to metal, wood, glass, enamel, ceramic, synthetic, plastic, or composite materials, or combinations thereof, such that the present invention is by no means limited to the specific material embodiments illustrated herein.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall there between.

The invention claimed is:

1. A handle, comprising:

a grip having a top end, a bottom end, a first side, a second side opposite said first side, a third side, and a fourth, combining to form an entire outer surface of the grip, wherein said first, second, third, and fourth sides extend between said top end and said bottom end;

wherein the first side comprises a convex curvature, originating from the top end and extending across a horizontal midpoint of the grip, the convex curvature transitioning to a concave curvature prior to a vertical midpoint of the grip, the concave curvature then transitioning to a second convex curvature that extends across the horizontal midpoint of the grip at the bottom end; and wherein said horizontal midpoint comprises a center line between said first side and said second side and said vertical midpoint comprises a center line between said top end and said bottom end;

wherein said horizontal midpoint center line is orthogonal to said vertical midpoint center line; and wherein at least one of said third or fourth side comprises an indented region having a length along a plane between the top end and the bottom end of the grip and having a width of the indented region along a plane between the first side and the second side of the grip, and wherein the horizontal midpoint center line runs along the length of the indented region and substantially through a center of the width of the indented region in at least one of the third and fourth side.

2. The handle of claim 1, wherein an effective diameter of the handle is greater than 1.5 cm (0.6 inches).

3. The handle of claim 1, wherein an effective outer circumference of the handle is greater than about 4 cm (1.57 inches).

4. The handle of claim 1, wherein the handle has an effective diameter of greater than 1.5 cm (0.6 inches), while simultaneously no cross-sectional portion of the handle has a thickness of greater than 1.5 cm (0.6 inches).

5. The handle of claim 1, wherein the handle has an effective diameter of about 2.5 cm (0.98 inches).

6. The handle of claim 1, wherein the handle has an effective outer circumference of about 7.9 cm (3.1 inches).

7. The handle of claim 1, wherein the third side also comprises the indented region, which is generally a mirror image configuration of the indented region of the fourth side.

8. The handle of claim 1, wherein the indented region of the third side and the indented region of the fourth side intersect creating an opening therethrough.

9. The handle of claim 1, wherein the handle comprises a generally L-shaped cross-section at said horizontal midpoint of the handle.

10. The handle of claim 1, wherein the handle is coupled to another structure to form container or implement.

11. The handle of claim 1, wherein the handle is disposed in combination with a blade to form a cutting tool.

12. The handle of claim 1, wherein the handle is coupled to a utensil.

13. The handle of claim 1, wherein the second side comprises a contoured surface having one convex curvature from the top end to the bottom end and extending across said vertical midpoint of the grip.

14. A container, comprising:

a base;

a wall surrounding the base and forming an interior chamber defined by the base and an opening with a rim opposite the base, the wall having an exterior surface and an interior surface;

a handle coupled with the wall, via a first connecting member and a second connecting member, at the exterior surface;

a grip on the handle and having a first end and a second end opposite the first end; wherein the first connecting member transitions from the wall proximal the rim to the grip proximal the first end, and the second connecting member transitions from the wall proximal the base to the grip proximal the second end, the first connecting member and the second connecting member connecting the grip with the wall of the container;

the grip of the handle comprising a first side distal from said container, a second side opposite said first side, a third side, and a fourth side, combining to form an entire outer surface of the grip;

wherein the first side comprises a contoured surface having a convex curvature where said first side contacts said first connecting member and extending beyond a horizontal midpoint of the grip, the convex curvature transitioning to a concave curvature prior to the vertical midpoint of the grip, the concave curvature then transitioning to a second convex curvature extending beyond the horizontal midpoint of the grip to where said first side contacts said second connecting member;

wherein said horizontal midpoint comprises a center line between said first side and said second side and said vertical midpoint comprises a center line between a top end and a bottom end of the grip;

wherein said horizontal midpoint center line is orthogonal to said vertical midpoint center line; and wherein at least one of said third or fourth side comprises an indented region having a length along a plane between the top end and the bottom end of the grip and having a width of the indented region along a plane between the first side and the second side of the grip, and wherein the horizontal midpoint center line runs along the length of the indented region and substantially through a center of the width of the indented region in at least one of the third and fourth side.

15. The container of claim 14 further comprising a stability nub disposed on a lower base portion of the second connecting member and providing stability and support for the handle and the container when resting on a flat surface.

16. The container of claim 14, wherein the second side is positioned to form a gap between the grip and the exterior surface of the wall of the container.

17. The container of claim 16, wherein the gap is sized and dimensioned to be about 2.2 cm (0.85 inches).

18. The container of claim 14, wherein the container comprises a mug or tea cup.

19. The container of claim 14, wherein an effective diameter of the handle is greater than 1.5 cm (0.6 inches).

20. The container of claim 14, wherein an effective outer circumference of the handle is greater than about 4 cm (1.57 inches).

21. The container of claim 14, wherein the handle has an effective diameter of greater than 1.5 cm (0.6 inches), while simultaneously no cross-sectional portion of the handle has a thickness of greater than 1.5 cm (0.6 inches).

22. The container of claim 14, wherein the handle has an effective diameter of about 2.5 cm (0.98 inches).

23. The container of claim 14, wherein the handle has an effective outer circumference of about 7.9 cm (3.1 inches).

24. The container of claim 14, wherein an indented region of the third side is generally a mirror image configuration of an indented region of the fourth side.

25. The container of claim 14, wherein an indented region of the third side and an indented region of the fourth side intersect creating an opening there through.

26. The container of claim 14, wherein the handle comprises a generally L-shaped cross- section at a vertical midpoint of the handle.

27. The container of claim 14, wherein the second side comprises a contoured surface having one convex curvature out from where the second side contacts the first connecting member and extending between the first and second connecting members and across said vertical midpoint of the grip.

28. A handle, comprising:

a grip with a top end, a bottom end, a first side distal from a container, a second side opposite said first side, a third side, and a fourth side, combining to form an entire outer surface of the grip;

at least one of said third or fourth side comprises an indented region;

wherein the indented region has a length along a plane between the top end and the bottom end of the grip and has a width of the indented region along a plane between the first side and the second side of the grip;

wherein the handle comprises a horizontal midpoint center line between said first side and said second side that runs along the length of the indented region and substantially through a center of the width of the indented region and a vertical midpoint center line between a top end of the grip and a bottom end of the grip;

wherein the horizontal midpoint center line is orthogonal to said vertical midpoint center line; and wherein the first side comprises a convex curvature, originating from the top end and extending across the horizontal midpoint centerline of the grip, the convex curvature transitioning to a concave curvature prior to the vertical midpoint centerline of the grip, the concave curvature then transitioning to a second convex curvature that extends across the horizontal midpoint centerline of the grip at the bottom end.

29. The handle of claim 28, wherein the second side comprises a contoured surface having one convex curvature from the top end to the bottom end and extending across said vertical midpoint of the grip.

* * * * *